US005456024A

United States Patent [19]

Klausmann et al.

[11] Patent Number: 5,456,024

[45] Date of Patent: Oct. 10, 1995

[54] METHOD OF AND APPARATUS FOR THE TREATMENT OF REFUSE OR GARBAGE ESPECIALLY HOUSEHOLD REFUSE

[76] Inventors: Hans Klausmann, Hüttenallee 63; Ralf Klausmann, Schönwasserstrasse 228, both of 47800 Krefeld, Germany

[21] Appl. No.: 301,599

[22] Filed: Sep. 7, 1994

[30] Foreign Application Priority Data

Oct. 9, 1993 [DE] Germany ..... 43 34 538.7
Jun. 28, 1994 [DE] Germany ..... 44 22 428.1

[51] Int. Cl.[6] ..... F26B 11/12; B01F 15/06

[52] U.S. Cl. ..... 34/386; 34/60; 34/135; 110/224; 241/DIG. 38

[58] Field of Search ..... 34/60, 135, 136, 34/137, 378, 379, 380, 386, 389, 384; 110/219, 222, 224, 226, 228; 241/22, 23, DIG. 10, DIG. 38

[56] References Cited

U.S. PATENT DOCUMENTS

| | | | |
|---|---|---|---|
| 1,101,129 | 6/1914 | Kitchen | 34/386 X |
| 4,557,204 | 12/1985 | Faehnle | 110/222 X |
| 5,024,770 | 6/1991 | Boyd et al. | 241/23 X |
| 5,184,780 | 2/1993 | Wiens | 241/DIG. 38 X |
| 5,244,274 | 9/1993 | Onodera | 34/135 X |

*Primary Examiner*—Edward K. Look
*Assistant Examiner*—Hoang Nguyen
*Attorney, Agent, or Firm*—Herbert Dubno

[57] ABSTRACT

An apparatus and a process for treating household refuse are disclosed. Household refuse or garbage is comminuted, dried and mixed with granular mineral substance, preferably sand, at a temperature of up to 1000° C. and the mixture is homogenized and degassed by the contact of the refuse with the hot sand until the garbage and refuse has been reduced in volume to a desired degree.

18 Claims, 1 Drawing Sheet

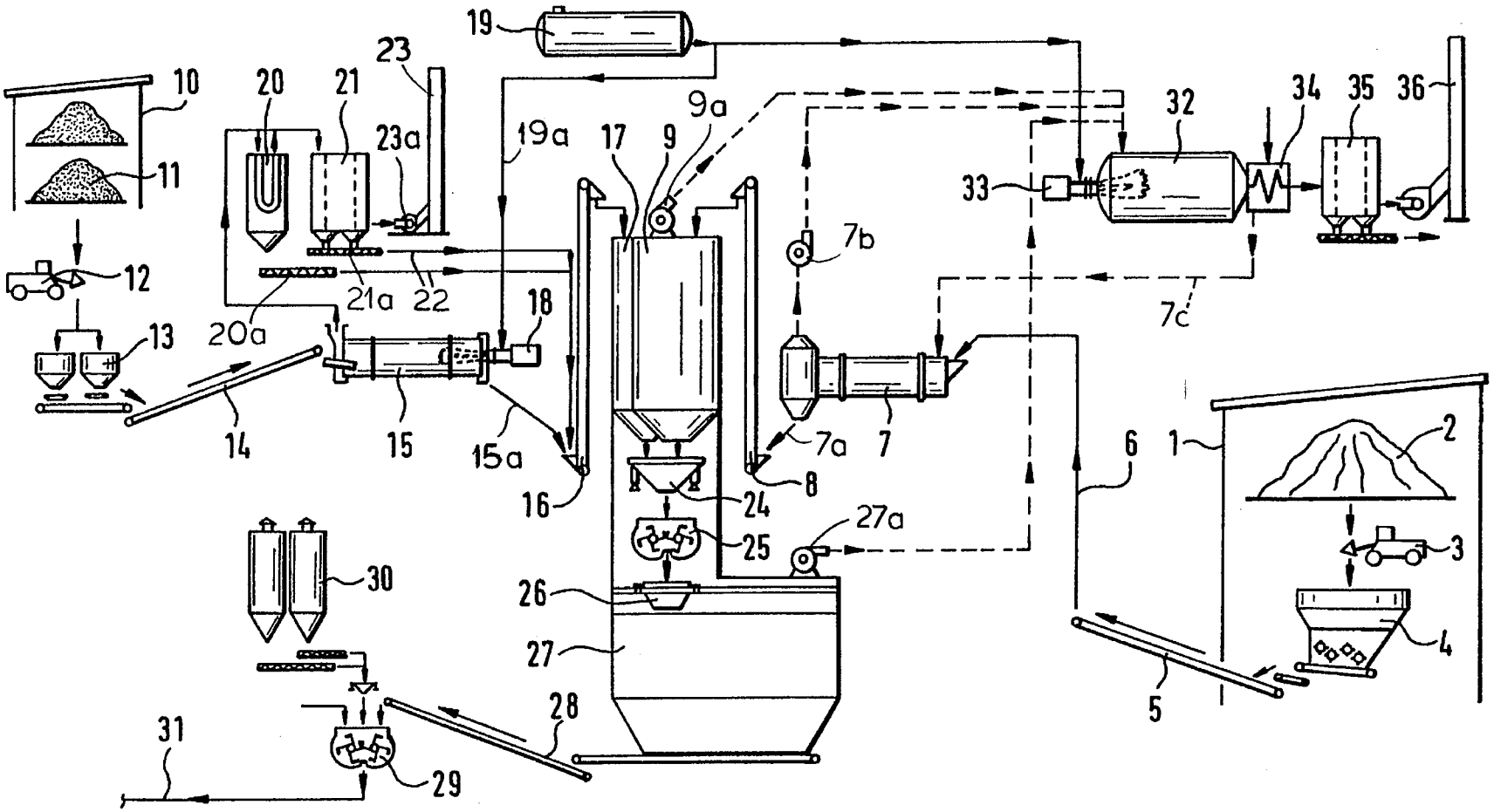
1
2
3
4
5
6
7
7a
7b
7c
8
9
9a
10
11
12
13
14
15
15a
16
17
18
19
19a
20
20a
21
21a
22
23
23a
24
25
26
27
27a
28
29
30
31
32
33
34
35
36

METHOD OF AND APPARATUS FOR THE TREATMENT OF REFUSE OR GARBAGE ESPECIALLY HOUSEHOLD REFUSE

FIELD OF THE INVENTION

Our present invention relates to a method of and to an apparatus for the treatment of refuse or garbage and especially household refuse or garbage.

BACKGROUND OF THE INVENTION

The terms "refuse" and "garbage" are here used interchangeably to refer primarily to the generally organic non-recyclable wastes produced in households and frequently referred to as municipal refuse or garbage.

Such refuse has been disposed of by and large in landfills which are increasingly under pressure because of lack of space, or in garbage or refuse incinerators. The latter disposal method has a number of drawbacks. Firstly, the investment or capital cost for constructing garbage incinerators is extremely high. Secondly, the refuse or garbage incineration gives rise to releases into the environment which can be considered environmentally hazardous and such incinerators have been frowned upon for environmental grounds practically universally.

The efforts to prevent environmental contamination by incinerators have also required high capital costs and in many cases are not fully successful. Finally, with respect to refuse or garbage incineration, a drawback is the fact that the incineration product does not have any significant utility and, for example, incinerator ash may require landfill disposal with some of the drawbacks previously enumerated.

OBJECTS OF THE INVENTION

It is, therefore, the principal object of the present invention to provide an improved method of treating refuse, especially household garbage, that with a minimum of investment or capital cost and environmentally safe a useable product can be obtained.

Another object of the invention is to provide a method of treating household refuse or garbage so that drawbacks of earlier systems are avoided.

Still another object of this invention is to provide an apparatus for the treatment of refuse or garbage which is of low capital cost and yet can dispose of the garbage without environmental hazard.

SUMMARY OF THE INVENTION

These objects and others which will become apparent hereinafter are attained, in accordance with the invention in a method of treating refuse, especially household garbage whereby the comminuted and dried refuse is mixed with mineral substances heated to a temperature of up to 1000° C., the mixture being homogeneous until the refuse has shrunk in volume to a desired degree. The refuse is preferably comminuted to a particle size of 0 to 50 mm, i.e. up to 50 mm and the drying of the refuse can be carried out at temperatures in excess of 100° C. The granular mineral substances which are used can include sand or the like. Metal granulates can also be used since they allow reuse of the granular mineral material following the shrinkage of the volume of the refuse by magnetic separation from the mixture.

The refuse which has been dried is mixed with the mineral substance heated to a temperature up to 1000° C. and preferably 25° to 800° C. depending upon the use of the product, in a cold state or at the drying temperature with a mixing ratio of preferably 1:1 and most advantageously with exclusion of air. This suppresses combustion of the refuse or garbage. By contact with the mineral matter in the homogenizing mixture, the refuse is degassed and shrinks, the shrinkage being a function of the time.

By contrast with conventional garbage incineration, no open flame is used in accordance with the invention and the high smoke evolution characteristic of garbage incineration can be avoided.

The process of the invention can be used to produce humus mixtures, especially as fillers and fertilizers for the garden and agricultural purposes.

Household garbage which normally comprises 60% organic components, has been found to be especially valuable upon conversion to a humus mixture by the method of the invention. For this purpose, the mineral substance is preheated to a temperature up to 500° C.

With such a temperature range, the organic substances retain a considerable degree of intactness so that they can provide valuable humus mixture. Additives like lime can be supplied to improve the quality of the humus.

Should the treated garbage be used as a construction material, the mineral substance can be heated to the maximum temperatures in the ranges given since, in such cases, the organic substances are decomposed to a greater extent to enable the mixture to be used directly for a variety of purposes in building material.

An apparatus for carrying out the method can have a refuse or garbage shredder followed by a drying drum and a refuse or garbage silo or bin for storing the dry product. The granular mineral substance is heated in a mineral heater and stored in a mineral silo or bin. Metering scales can deliver the two components to a mixer which is followed by a thermal reactor.

Preferably the metering scales, the mixer and the thermal reactor are provided with means for excluding air therefrom. It suffices to provide these elements of the apparatus so that air is excluded since the heated mineral substance and the dry refuse first come into contact with one another in the region of the metering scale.

The drying drum for the refuse is advantageously designed with a double wall or jacket for indirect heating of the refuse and an after-burner is provided for the drying drum, the refuse silo or the thermal reactor to combust the gas drawn off from them. The combustion gases, in turn, from the after-burner, can be used to heat the drying drum.

The combustion gases which are not used to heat the drying drum can be cleaned or dedusted before they are supplied to a chimney or stack. The miner heater is preferably a directly-heated drying drum or rotary kiln and the waste gases leaving the mineral heater are dedusted before they are released into the atmosphere. The dedusting unit which can be a filter, e.g. a bag filter, cyclone or electrostatic filter or a combination thereof, collects solids which can be supplied to the mineral silo or bin.

The thermal reactor can be provided upstream of a further mixer in which lime or the like can be added when the product is a humus for filling and fertilizing of garden or agricultural plots, or cement when the mixture is to form a construction material like concrete.

The method of the invention may therefore comprise the steps of:

(a) comminuting refuse;

(b) heating a granular mineral substance to a temperature up to 1000° C.;

(c) mixing the refuse comminuted in step (a) in a dry state with the granular mineral substance heated in step (b) to said temperature up to 1000° C.; and (d) homogenizing the mixture formed in step (c) for a period sufficient to shrink a volume of said refuse to a predetermined reduced volume.

It its broadest terms, the apparatus can comprise:

means for comminuting refuse;

means for heating a granular mineral substance to a temperature up to 1000° C.;

means for mixing the comminuted refuse in a dry state with the heated granular mineral substance at said temperature up to 1000° C.; and means for homogenizing the mixture for a period sufficient to shrink a volume of said refuse to a predetermined reduced volume.

BRIEF DESCRIPTION OF THE DRAWING

The above and other objects, features, and advantages will become more readily apparent from the following description, reference being made to the sole FIGURE of which is a flow diagram illustrating an apparatus for the treatment of garbage or refuse.

SPECIFIC DESCRIPTION

In a covered chamber 1 in which sanitary storage is provided for the refuse 2, a front-end loader 3 can feed the household garbage to a refuse shredder 4 where it is comminuted to a particle size of up to 50 mm.

The comminuted refuse is fed via a closed endless belt system 5 and an elevator or flight conveyor or bucket lifter 6 to a drying drum 7 which can have a double wall or jacket for indirect heating of the refuse which is dried at a temperature in excess of 100° C.

From the drying drum 7, the dried refuse **7*a* is fed to a further bucket elevator 8 which deposits the dried and comminuted refuse in a refuse silo or bin 9**.

From open storage or a closed structure 10, designed to prevent excess wetting of the mineral substance, a granular mineral substance, namely, the stored sand, is delivered by the front-end loader 12 to a pair of metering chambers 13 from which the sand is fed via a conveying belt 14 to a rotary kiln 15 forming the mineral heater. In the rotary kiln 15, the sand is heated to a temperature up to 1000° C., this temperature being preferably adjustable to a value between 250° and 800° C. The heated sand **15*a* is fed by a bucket elevator 16 into the mineral silo or bin 17**.

The rotary kiln 15 is provided directly with a burner 18 opening into the kiln and fed with fuel and air. The fuel is supplied at **19*a* from a fuel tank 19. The combustion exhaust gases from the rotary kiln 15 pass through a preliminary separator such as a bag filter or cyclone and an electrostatic filter 21 before being expelled via the blower 23*a* and the stack 23 into the atmosphere. The units 20 and 21 form a deduster from which the collected solids are fed by conveyors 20*a* and 21*a* as represented by the arrows 22 to the bucket elevator 16 for delivery to the mineral silo or bin 17**.

Below the bins 9 and 17, there is provided a metering scale 24 which weigh out the hot sand and dry refuse in a predetermined amount ratio, preferably of 1:1. The products in the metering scale 24 are delivered to a mixer 25 in which the components are blended together, whereupon the mixture passes via a bottom-dump bucket 26 into a thermal reactor 27.

The metering scale 24, the mixer 25, the bottom-dump bucket 26 and the thermal reactor are all closed against the incursion of air so that the refuse is degassed without combustion and shrinks to a significantly reduced volume.

A conveyor 28 extracts the mixture from the thermal reactor 27 and feeds it to a further mixer 29 from which the silos or bins 30 can feed additives to the mixture. These additives can be lime when the product is intended as a garden or agricultural-plot filler or fertilizer, or cement when the mixture is to form a concrete or other building material. The product is let off for further processing or use as represented by the arrow 31.

The exhaust gases evolved in the drying drum 7, the refuse silo 9 and the thermal reactor 27 are drawn by blowers **7*b*, 9*a* and 27*a* from these units and fed to an after-burner 32 in which they are combusted with a fuel-fired burner 33 receiving its fuel from the tank 19**.

The combustion gases are partly fed at **7*c* to the jacket of the drying drum 7. The remaining combustion gas is fed through a cooler 34 and a filter 35 to the stack 36**.

We claim:

1. A method of treating refuse for disposal which comprises the steps of:

(a) comminuting refuse;

(b) heating a granular mineral substance to a temperature up to 1000° C.;

(c) mixing the refuse comminuted in step (a) in a dry state with the granular mineral substance heated in step (b) to said temperature up to 1000° C.; and (d) homogenizing the mixture formed in step (c) for a period sufficient to shrink a volume of said refuse to a predetermined reduced volume.

2. The method defined in claim 1 wherein said refuse is comminuted in step (a) to a particle size of at most 50 mm.

3. The method defined in claim 1 wherein said refuse is dried at a temperature in excess of 100° C.

4. The method defined in claim 1 wherein the mixing in step (c) is carried out with exclusion of air.

5. The method defined in claim 1 wherein said mineral substance is sand.

6. The method defined in claim 1 wherein said mineral substance is a metal granulate which is recovered from said mixture after shrinking of the volume of the refuse for reuse.

7. The method defined in claim 1 wherein said mineral substance is heated in step (b) to a temperature of 250° to 800° C.

8. The method defined in claim 1 wherein the refuse is mixed with the mineral substance in a ratio of substantially 1:1.

9. The method defined in claim 1 for producing a humus as a filler or fertilizer for a garden or agricultural plot, wherein the mineral substance is heated in step (b) to a temperature of up to 500° C.

10. The method defined in claim 1, further comprising the step of adding lime as an additive to said mixture.

11. An apparatus for treating refuse for disposal which comprises:

means for comminuting refuse;

means for heating a granular mineral substance to a temperature up to 1000° C.;

means for mixing the comminuted refuse in a dry state with the heated granular mineral substance at said temperature up to 1000° C.; and means for homogenizing the mixture for a period sufficient to shrink a volume of said refuse to a predetermined reduced volume.

12. The apparatus defined in claim 11 wherein:

said means for comminuting includes a refuse shredder, a drying drum connected to said refuse shredder for drying the comminuted refuse, and a refuse bin for holding dried comminuted refuse;

said means for heating comprises a heater for heating said mineral substance and a mineral bin for holding heated mineral substance; and said means for mixing includes a metering scale receiving the mineral substance from the mineral bin and the comminuted refuse from the refuse bin, a mixer receiving said mineral substance and said comminuted refuse from said metering scale, and a thermal reactor for reacting said mixture at an elevated temperature.

13. The apparatus defined in claim 12 wherein said metering scale, said mixer and said thermal reactor are provided with means for excluding air therefrom.

14. The apparatus defined in claim 12 wherein said drying drum is provided with a double-wall jacket for indirectly heating the refuse therein.

15. The apparatus defined in claim 12 wherein at least one of said drying drum, said refuse silo and said thermal reactor is provided with an afterburner for combusting gas therefrom to produce a hot gas product, said drying drum being connected to said afterburner for heating thereby.

16. The apparatus defined in claim 12 wherein said heater is a direct fired rotary kiln.

17. The apparatus defined in claim 12, further comprising a deduster connected to said heater and recovering solids from gas effluent therefrom, and means for delivering said solids to said mineral bin.

18. The apparatus defined in claim 12, further comprising a further mixer downstream of said thermal reactor.

* * * * *